US007146956B2

(12) United States Patent
Nomura et al.

(10) Patent No.: US 7,146,956 B2
(45) Date of Patent: Dec. 12, 2006

(54) VALVE TRAIN FOR INTERNAL COMBUSTION ENGINE

(75) Inventors: Shin Nomura, Yokohama (JP); Takahiro Miura, Yokohama (JP); Makoto Kano, Yokohama (JP); Yutaka Mabuchi, Yokohama (JP); Takahiro Hamada, Yokohama (JP); Miki Murakami, Huntington Beach, CA (US)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/912,575

(22) Filed: Aug. 6, 2004

(65) Prior Publication Data

US 2005/0056241 A1 Mar. 17, 2005

(30) Foreign Application Priority Data

Aug. 8, 2003 (JP) ..... 2003-206671

(51) Int. Cl.
*F01L 1/04* (2006.01)

(52) U.S. Cl. ..... 123/90.6; 123/90.34; 508/291; 508/487

(58) Field of Classification Search ..... 123/90.6, 123/90.34; 508/291, 487
See application file for complete search history.

(56) References Cited

U.S. PATENT DOCUMENTS

| | | | |
|---|---|---|---|
| 1,461 | A | 12/1839 | Day |
| 2,716,972 | A | 9/1955 | Farny et al. |
| 2,982,733 | A | 5/1961 | Wright et al. |
| 3,211,647 | A | 10/1965 | O'Halloran et al. |
| 3,790,315 | A | 2/1974 | Emanuelsson et al. |
| 3,846,162 | A | 11/1974 | Bloom |
| 3,932,228 | A | 1/1976 | Sugiyama et al. |
| 4,031,023 | A | 6/1977 | Musser et al. |
| 4,367,130 | A | 1/1983 | Lemelson |
| 4,385,880 | A | 5/1983 | Lemelson |
| 4,538,929 | A | 9/1985 | Ehrentraut et al. |
| 4,554,208 | A | 11/1985 | MacIver et al. |
| 4,645,610 | A | 2/1987 | Born et al. |
| 4,702,808 | A | 10/1987 | Lemelson |
| 4,712,982 | A | 12/1987 | Inagaki et al. |
| 4,755,237 | A | 7/1988 | Lemelson |
| 4,755,426 | A | 7/1988 | Kokai et al. |
| 4,783,368 | A | 11/1988 | Yamamoto et al. |
| 4,834,400 | A | 5/1989 | Lebeck |
| 4,842,755 | A | 6/1989 | Dunn |

(Continued)

FOREIGN PATENT DOCUMENTS

| | | |
|---|---|---|
| CA | 2009582 | 8/1990 |

(Continued)

OTHER PUBLICATIONS

U.S. Appl. No. 10/468,713, filed Aug. 22, 2003, Mabuchi et al.

(Continued)

*Primary Examiner*—Thomas Denion
*Assistant Examiner*—Zelalem Eshete
(74) *Attorney, Agent, or Firm*—Foley & Lardner LLP

(57) ABSTRACT

A valve train for an internal combustion engine is comprised of a lubricating oil, and a camshaft which is made of an iron-based material and comprises a cam lobe and a camshaft journal. The camshaft slidingly moves on a counterpart thereof through the lubricating oil. A hard carbon film is formed on at least one of a sliding portion of the camshaft and the counterpart made of an iron-based material. A hydrogen amount of the hard carbon film is 10 atomic percent or less.

7 Claims, 2 Drawing Sheets

U.S. PATENT DOCUMENTS

| | | | | |
|---|---|---|---|---|
| 4,859,493 | A | | 8/1989 | Lemelson |
| 4,874,596 | A | | 10/1989 | Lemelson |
| 4,919,974 | A | | 4/1990 | McCune et al. |
| 4,933,058 | A | | 6/1990 | Bache et al. |
| 4,943,345 | A | | 7/1990 | Asmussen et al. |
| 4,960,643 | A | | 10/1990 | Lemelson |
| 4,974,498 | A | | 12/1990 | Lemelson |
| 4,980,021 | A | | 12/1990 | Kitamura et al. |
| 4,980,610 | A | | 12/1990 | Varga |
| 4,981,717 | A | | 1/1991 | Thaler |
| 4,988,421 | A | | 1/1991 | Drawl et al. |
| 4,992,082 | A | | 2/1991 | Drawl et al. |
| 5,000,541 | A | | 3/1991 | DiMarcello et al. |
| 5,021,628 | A | | 6/1991 | Lemelson |
| 5,032,243 | A | | 7/1991 | Bache et al. |
| 5,036,211 | A | | 7/1991 | Scott |
| 5,040,501 | A | | 8/1991 | Lemelson |
| 5,067,826 | A | | 11/1991 | Lemelson |
| 5,077,990 | A | | 1/1992 | Plath |
| 5,078,848 | A | | 1/1992 | Anttila et al. |
| 5,087,608 | A | | 2/1992 | Chan et al. |
| 5,096,352 | A | | 3/1992 | Lemelson |
| 5,110,435 | A | | 5/1992 | Haberland |
| 5,112,025 | A | | 5/1992 | Nakayama et al. |
| 5,127,314 | A | | 7/1992 | Swain |
| 5,131,941 | A | | 7/1992 | Lemelson |
| 5,132,587 | A | | 7/1992 | Lemelson |
| 5,142,785 | A | | 9/1992 | Grewal et al. |
| 5,143,634 | A | * | 9/1992 | Quinga et al. ..... 508/281 |
| 5,148,780 | A | | 9/1992 | Urano et al. |
| 5,187,021 | A | | 2/1993 | Vydra et al. |
| 5,190,807 | A | | 3/1993 | Kimock et al. |
| 5,190,824 | A | | 3/1993 | Itoh |
| 5,202,156 | A | | 4/1993 | Yamamoto et al. |
| 5,205,188 | A | | 4/1993 | Repenning et al. |
| 5,205,305 | A | | 4/1993 | Yamakita |
| H1210 | H | | 7/1993 | Jansen |
| 5,232,568 | A | | 8/1993 | Parent et al. |
| 5,237,967 | A | | 8/1993 | Willermet et al. |
| 5,249,554 | A | | 10/1993 | Tamor et al. |
| 5,255,783 | A | | 10/1993 | Goodman et al. |
| 5,255,929 | A | | 10/1993 | Lemelson |
| 5,284,394 | A | | 2/1994 | Lemelson |
| 5,288,556 | A | | 2/1994 | Lemelson |
| 5,295,305 | A | | 3/1994 | Hahn et al. |
| 5,299,937 | A | | 4/1994 | Gow |
| 5,317,938 | A | | 6/1994 | de Juan, Jr. et al. |
| 5,326,488 | A | * | 7/1994 | Minokami et al. ..... 508/289 |
| 5,332,348 | A | | 7/1994 | Lemelson |
| 5,334,306 | A | | 8/1994 | Dautremont-Smith et al. |
| 5,349,265 | A | | 9/1994 | Lemelson |
| 5,358,402 | A | | 10/1994 | Reed et al. |
| 5,359,170 | A | | 10/1994 | Chen et al. |
| 5,360,227 | A | | 11/1994 | Lemelson |
| 5,380,196 | A | | 1/1995 | Kelly et al. |
| 5,401,543 | A | | 3/1995 | O'Neill et al. |
| H1461 | H | | 7/1995 | DiVita et al. |
| 5,432,539 | A | | 7/1995 | Anderson |
| 5,433,977 | A | | 7/1995 | Sarin et al. |
| H1471 | H | | 8/1995 | Braun et al. |
| 5,443,032 | A | | 8/1995 | Vichr et al. |
| 5,447,208 | A | | 9/1995 | Lund et al. |
| 5,456,406 | A | | 10/1995 | Lemelson |
| 5,458,754 | A | | 10/1995 | Sathrum et al. |
| 5,461,648 | A | | 10/1995 | Nauflett et al. |
| 5,462,772 | A | | 10/1995 | Lemelson |
| 5,464,667 | A | | 11/1995 | Köhler et al. |
| 5,466,431 | A | | 11/1995 | Dorfman et al. |
| 5,479,069 | A | | 12/1995 | Winsor |
| 5,482,602 | A | | 1/1996 | Cooper et al. |
| 5,491,028 | A | | 2/1996 | Sarin et al. |
| 5,497,550 | A | | 3/1996 | Trotta et al. |
| 5,509,841 | A | | 4/1996 | Winsor |
| 5,516,729 | A | | 5/1996 | Dawson et al. |
| 5,529,815 | A | | 6/1996 | Lemelson |
| 5,531,878 | A | | 7/1996 | Vadgama et al. |
| 5,541,566 | A | | 7/1996 | Deeney |
| 5,547,716 | A | | 8/1996 | Thaler |
| 5,551,959 | A | | 9/1996 | Martin et al. |
| 5,552,675 | A | | 9/1996 | Lemelson |
| 5,568,391 | A | | 10/1996 | Mckee |
| 5,593,719 | A | | 1/1997 | Dearnaley et al. |
| 5,616,372 | A | | 4/1997 | Conley et al. |
| 5,619,889 | A | | 4/1997 | Jones et al. |
| 5,628,881 | A | | 5/1997 | Lemelson |
| 5,630,275 | A | | 5/1997 | Wexler |
| 5,630,953 | A | | 5/1997 | Klink |
| 5,653,300 | A | | 8/1997 | Lund et al. |
| 5,669,144 | A | | 9/1997 | Hahn et al. |
| 5,672,054 | A | | 9/1997 | Cooper et al. |
| 5,688,557 | A | | 11/1997 | Lemelson et al. |
| 5,707,409 | A | | 1/1998 | Martin et al. |
| 5,714,202 | A | | 2/1998 | Lemelson et al. |
| 5,719,109 | A | * | 2/1998 | Tokashiki et al. ..... 508/364 |
| 5,723,207 | A | | 3/1998 | Lettington et al. |
| 5,731,046 | A | | 3/1998 | Mistry et al. |
| 5,735,769 | A | | 4/1998 | Takemura et al. |
| 5,740,941 | A | | 4/1998 | Lemelson |
| 5,775,817 | A | * | 7/1998 | Gottemoller et al. ..... 384/434 |
| 5,786,038 | A | | 7/1998 | Conley et al. |
| 5,790,146 | A | | 8/1998 | Anderson |
| 5,793,390 | A | | 8/1998 | Clafflin et al. |
| 5,794,801 | A | | 8/1998 | Lemelson |
| 5,799,549 | A | | 9/1998 | Decker et al. |
| 5,806,557 | A | | 9/1998 | Helge |
| 5,824,387 | A | | 10/1998 | Boutaghou et al. |
| 5,834,708 | A | | 11/1998 | Svetal et al. |
| 5,840,662 | A | | 11/1998 | Nibert et al. |
| 5,843,571 | A | | 12/1998 | Sho |
| 5,851,962 | A | | 12/1998 | Kaga |
| 5,866,195 | A | | 2/1999 | Lemelson |
| 5,871,805 | A | | 2/1999 | Lemelson |
| 5,881,444 | A | | 3/1999 | Schaefer et al. |
| 5,901,021 | A | | 5/1999 | Hirano et al. |
| 5,910,940 | A | | 6/1999 | Guerra |
| 5,927,897 | A | | 7/1999 | Attar |
| 5,937,812 | A | * | 8/1999 | Reedy et al. ..... 123/90.34 |
| 5,940,975 | A | | 8/1999 | Decker et al. |
| 5,945,214 | A | | 8/1999 | Ma et al. |
| 5,947,710 | A | | 9/1999 | Cooper et al. |
| 5,952,102 | A | | 9/1999 | Cutler |
| 5,958,261 | A | | 9/1999 | Offer et al. |
| 5,960,762 | A | | 10/1999 | Imai |
| 5,967,250 | A | | 10/1999 | Lund et al. |
| 5,968,596 | A | | 10/1999 | Ma et al. |
| 5,975,686 | A | | 11/1999 | Hauck et al. |
| 5,976,707 | A | | 11/1999 | Grab |
| 5,992,268 | A | | 11/1999 | Decker et al. |
| 5,993,938 | A | | 11/1999 | Tsukuda et al. |
| 6,006,415 | A | | 12/1999 | Schaefer et al. |
| 6,015,597 | A | | 1/2000 | David |
| 6,016,000 | A | | 1/2000 | Moslehi |
| 6,023,979 | A | | 2/2000 | Bills et al. |
| 6,028,393 | A | | 2/2000 | Izu et al. |
| 6,051,298 | A | | 4/2000 | Ko et al. |
| 6,056,443 | A | | 5/2000 | Koike et al. |
| 6,059,460 | A | | 5/2000 | Ono et al. |
| 6,059,830 | A | | 5/2000 | Lippincott, III et al. |
| 6,071,597 | A | | 6/2000 | Yang et al. |
| 6,083,313 | A | | 7/2000 | Venkatraman et al. |
| 6,083,570 | A | | 7/2000 | Lemelson et al. |
| 6,095,690 | A | | 8/2000 | Niegel et al. |
| 6,099,541 | A | | 8/2000 | Klopotek |
| 6,099,976 | A | | 8/2000 | Lemelson et al. |

6,106,919 A 8/2000 Lee et al.
6,124,198 A 9/2000 Moslehi
6,139,964 A 10/2000 Sathrum et al.
6,142,481 A 11/2000 Iwashita et al.
6,145,608 A 11/2000 Lund et al.
6,156,439 A 12/2000 Coffinberry
6,159,558 A 12/2000 Wolfe et al.
6,160,683 A 12/2000 Boutaghou
6,165,616 A 12/2000 Lemelson et al.
6,170,156 B1 1/2001 Lev et al.
6,171,343 B1 1/2001 Dearnaley et al.
6,173,913 B1 1/2001 Shafer et al.
6,190,514 B1 2/2001 Ma et al.
6,193,906 B1 2/2001 Kaneko et al.
6,197,120 B1 3/2001 David
6,197,428 B1 3/2001 Rogers
6,203,651 B1 3/2001 Järvenkylä et al.
6,205,291 B1 3/2001 Hughes et al.
6,207,625 B1 3/2001 Ogano et al.
6,227,056 B1 5/2001 Bills et al.
6,237,441 B1 5/2001 Nishioka
6,237,852 B1 5/2001 Svetal et al.
6,238,839 B1 5/2001 Tomita et al.
6,255,262 B1 7/2001 Keenan et al.
6,261,424 B1 7/2001 Goncharenko et al.
6,273,793 B1 8/2001 Liners et al.
6,274,220 B1 8/2001 Tsukuda et al.
6,289,593 B1 9/2001 Decker et al.
6,293,648 B1 9/2001 Anderson
6,296,552 B1 10/2001 Boutaghou et al.
6,299,425 B1 10/2001 Hirano et al.
6,305,416 B1 10/2001 Snel et al.
6,309,283 B1 10/2001 Liners et al.
6,311,524 B1 11/2001 Brennan, III et al.
6,316,734 B1 11/2001 Yang
6,322,431 B1 11/2001 Schaenzer et al.
6,322,719 B1 11/2001 Kaneko et al.
6,324,060 B1 11/2001 Hsu
6,325,385 B1 12/2001 Iwashita et al.
6,329,328 B1 12/2001 Koganei et al.
6,333,298 B1 12/2001 Waddoups et al.
6,338,881 B1 1/2002 Sellschopp et al.
6,340,245 B1 1/2002 Horton et al.
6,358,123 B1 3/2002 Liners et al.
6,367,705 B1 4/2002 Lee et al.
6,368,676 B1 4/2002 Gaudreau et al.
6,377,422 B1 4/2002 Boutaghou et al.
6,379,383 B1 4/2002 Palmaz et al.
6,385,987 B1 5/2002 Schlom et al.
6,386,468 B1 5/2002 Neuberger et al.
6,399,215 B1 6/2002 Zhu et al.
6,401,058 B1 6/2002 Akalin et al.
6,439,845 B1 8/2002 Veres
6,439,986 B1 8/2002 Myoung et al.
6,452,752 B1 9/2002 Boutaghou
6,468,642 B1 10/2002 Bray et al.
6,471,979 B1 10/2002 New et al.
6,494,881 B1 12/2002 Bales et al.
6,523,456 B1 2/2003 Kobayashi et al.
6,524,212 B1 2/2003 Ushijima et al.
6,534,141 B1 3/2003 Hull, Jr. et al.
6,537,310 B1 3/2003 Palmaz et al.
6,537,429 B1 3/2003 O'Donnell et al.
6,543,394 B1 4/2003 Tinney
6,544,308 B1 4/2003 Griffin et al.
6,553,957 B1 4/2003 Ishikawa et al.
6,557,968 B1 5/2003 Lee et al.
6,562,445 B1 5/2003 Iwamura
6,562,462 B1 5/2003 Griffin et al.
6,570,172 B1 5/2003 Kim et al.
6,572,651 B1 6/2003 DeScheerder et al.
6,572,935 B1 6/2003 He et al.
6,572,937 B1 6/2003 Hakovirta et al.
6,585,064 B1 7/2003 Griffin et al.
6,586,069 B1 7/2003 Dykes et al.
6,589,640 B1 7/2003 Griffin et al.
6,592,519 B1 7/2003 Martinez
6,592,985 B1 7/2003 Griffin et al.
6,601,662 B1 8/2003 Matthias et al.
6,626,949 B1 9/2003 Townley
6,629,906 B1 10/2003 Chiba et al.
6,637,528 B1 10/2003 Nishiyama et al.
6,638,569 B1 10/2003 McLaughlin et al.
6,645,354 B1 11/2003 Gorokhovsky
6,656,329 B1 12/2003 Ma et al.
6,658,941 B1 12/2003 Bills et al.
6,666,328 B1 12/2003 Sykora
6,666,671 B1 12/2003 Olver et al.
6,684,513 B1 2/2004 Clipstone et al.
6,684,759 B1 2/2004 Gorokhovsky
6,695,865 B1 2/2004 Boyle et al.
6,699,106 B1 3/2004 Myoung et al.
6,701,627 B1 3/2004 Korb et al.
6,715,693 B1 4/2004 Dam et al.
6,726,993 B1 4/2004 Teer et al.
6,729,350 B1 5/2004 Schick
6,729,527 B1 5/2004 Sonnenreich et al.
6,733,513 B1 5/2004 Boyle et al.
6,739,214 B1 5/2004 Griffin et al.
6,739,238 B1 5/2004 Ushijima et al.
6,740,393 B1 5/2004 Massler et al.
6,745,742 B1 6/2004 Meyer
6,749,033 B1 6/2004 Griffin et al.
6,753,042 B1 6/2004 Bakounine et al.
6,753,635 B1 6/2004 Kuhlmann-Wilsdorf
6,761,532 B1 7/2004 Capone et al.
6,761,736 B1 7/2004 Woo et al.
6,780,177 B1 8/2004 Shafirstein et al.
6,797,326 B1 9/2004 Griffin et al.
6,799,468 B1 10/2004 Borenstein
6,806,242 B1 * 10/2004 Shirahama et al. ..... 508/291
6,818,029 B1 11/2004 Myoung et al.
6,820,676 B1 11/2004 Palmaz et al.
6,821,189 B1 11/2004 Coad et al.
6,821,624 B1 11/2004 Utsumi et al.
6,822,788 B1 11/2004 Blitstein
6,849,085 B1 2/2005 Marton
6,855,237 B1 2/2005 Kolpakov et al.
6,855,791 B1 2/2005 Van Doren et al.
6,861,098 B1 3/2005 Griffin et al.
6,861,137 B1 3/2005 Griffin et al.
6,865,952 B1 3/2005 Bills et al.
6,866,894 B1 3/2005 Trankiem et al.
6,871,700 B1 3/2005 Gorokhovsky
6,872,203 B1 3/2005 Shafirstein et al.
6,878,447 B1 4/2005 Griffin et al.
6,880,469 B1 4/2005 Frost
6,882,094 B1 4/2005 Dimitrijevic et al.
6,883,476 B1 4/2005 Nohara et al.
6,886,521 B1 5/2005 Hamada et al.
6,887,585 B1 5/2005 Herbst-Dederichs
6,890,700 B1 5/2005 Tomita et al.
6,893,720 B1 5/2005 Nakahigashi et al.
6,969,198 B1 11/2005 Konishi et al.
2001/0036800 A1 11/2001 Liners et al.
2002/0026899 A1 3/2002 McLaughlin et al.
2002/0031987 A1 3/2002 Liners et al.
2002/0034631 A1 3/2002 Griffin et al.
2002/0034632 A1 3/2002 Griffin et al.
2002/0051286 A1 5/2002 Blitstein
2002/0070357 A1 6/2002 Kim et al.
2002/0074168 A1 6/2002 Matthias et al.
2002/0089571 A1 7/2002 Lee et al.
2002/0090155 A1 7/2002 Ushijima et al.
2002/0090578 A1 7/2002 Schaefera et al.
2002/0130219 A1 9/2002 Parseghian et al.

| | | | |
|---|---|---|---|
| 2002/0148430 | A1 | 10/2002 | Kano et al. |
| 2002/0155015 | A1 | 10/2002 | Esumi et al. |
| 2002/0175476 | A1 | 11/2002 | Chinou et al. |
| 2003/0012234 | A1 | 1/2003 | Watson et al. |
| 2003/0019111 | A1 | 1/2003 | Korb et al. |
| 2003/0019332 | A1 | 1/2003 | Korb et al. |
| 2003/0021995 | A1 | 1/2003 | Griffin et al. |
| 2003/0034182 | A1 | 2/2003 | Griffin et al. |
| 2003/0035957 | A1 | 2/2003 | Griffin et al. |
| 2003/0035958 | A1 | 2/2003 | Griffin et al. |
| 2003/0036341 | A1 | 2/2003 | Myoung et al. |
| 2003/0037640 | A1 | 2/2003 | Griffin et al. |
| 2003/0069632 | A1 | 4/2003 | De Scheerder et al. |
| 2003/0108777 | A1 | 6/2003 | Gunsel et al. |
| 2003/0114094 | A1 | 6/2003 | Myoung et al. |
| 2003/0128903 | A1 | 7/2003 | Yasuda et al. |
| 2003/0159919 | A1 | 8/2003 | Fairbairn et al. |
| 2003/0162672 | A1 | 8/2003 | Shirahama et al. |
| 2003/0168323 | A1 | 9/2003 | Frost |
| 2003/0180565 | A1 | 9/2003 | Herbst-Dederichs |
| 2003/0199741 | A1 | 10/2003 | Martinez |
| 2003/0234371 | A1 | 12/2003 | Ziegler |
| 2003/0235691 | A1 | 12/2003 | Griffin et al. |
| 2004/0003638 | A1 | 1/2004 | Schaefer et al. |
| 2004/0008406 | A1 | 1/2004 | Blitstein |
| 2004/0010068 | A1 | 1/2004 | Doren et al. |
| 2004/0011900 | A1 | 1/2004 | Gebhardt et al. |
| 2004/0027018 | A1 | 2/2004 | LeBlanc et al. |
| 2004/0035375 | A1 | 2/2004 | Gibisch et al. |
| 2004/0074467 | A1 | 4/2004 | Hamada et al. |
| 2004/0092405 | A1 | 5/2004 | Konishi et al. |
| 2004/0105806 | A1 | 6/2004 | Griffin et al. |
| 2004/0109621 | A1 | 6/2004 | Frost |
| 2004/0115435 | A1 | 6/2004 | Griffin et al. |
| 2004/0133301 | A1 | 7/2004 | Van Doren et al. |
| 2004/0154570 | A1 | 8/2004 | Mabuchi et al. |
| 2004/0168326 | A1 | 9/2004 | Korb et al. |
| 2004/0184687 | A1 | 9/2004 | Morales et al. |
| 2004/0223256 | A1 | 11/2004 | Feng et al. |
| 2004/0241448 | A1 | 12/2004 | Kano et al. |
| 2004/0242435 | A1 | 12/2004 | Nishimura et al. |
| 2004/0244539 | A1 | 12/2004 | Korb et al. |
| 2004/0261614 | A1 | 12/2004 | Hamada et al. |
| 2005/0001201 | A1 | 1/2005 | Bocko et al. |
| 2005/0005892 | A1 | 1/2005 | Nishimura et al. |
| 2005/0025975 | A1 | 2/2005 | Okamoto et al. |
| 2005/0035222 | A1 | 2/2005 | Hamada et al. |
| 2005/0037879 | A1 | 2/2005 | Murata et al. |
| 2005/0061291 | A1 | 3/2005 | Nishimura et al. |
| 2005/0061636 | A1 | 3/2005 | Frost et al. |
| 2005/0064196 | A1 | 3/2005 | Martin et al. |
| 2005/0082139 | A1 | 4/2005 | Ishikawa et al. |
| 2005/0084390 | A1 | 4/2005 | Ueno et al. |
| 2005/0089685 | A1 | 4/2005 | Hamada et al. |
| 2005/0098134 | A1 | 5/2005 | Nishimura et al. |
| 2005/0100701 | A1 | 5/2005 | Hamada et al. |
| 2005/0115744 | A1 | 6/2005 | Griffin et al. |
| 2005/0188942 | A1 | 9/2005 | Hamada et al. |

FOREIGN PATENT DOCUMENTS

| | | | |
|---|---|---|---|
| DE | 643 034 | | 3/1937 |
| DE | 19507086 | A1 | 9/1996 |
| DE | 19507086 | C2 | 9/1996 |
| DE | 197 04 224 | | 8/1997 |
| DE | 198 15 989 | | 10/1999 |
| DE | 198 25 860 | | 12/1999 |
| DE | 19825860 | A1 | 12/1999 |
| DE | 100 17 459 | | 10/2000 |
| DE | 100 61 397 | A1 | 5/2002 |
| DE | 101 58 683 | | 6/2003 |
| DE | 103 18 135 | | 11/2003 |
| DE | 10337559 | A1 | 3/2005 |
| EP | 0 286 996 | | 10/1988 |
| EP | 0 291 006 | A2 | 11/1988 |
| EP | 0 299 785 | | 1/1989 |
| EP | 0308143 | B1 | 3/1989 |
| EP | 0 333 416 | | 9/1989 |
| EP | 0378378 | B1 | 7/1990 |
| EP | 0384772 | A1 | 8/1990 |
| EP | 0388800 | A2 | 9/1990 |
| EP | 0392125 | A1 | 10/1990 |
| EP | 0398985 | B1 | 11/1990 |
| EP | 407977 | A1 * | 1/1991 |
| EP | 0 435 312 | | 7/1991 |
| EP | 0474369 | A1 | 3/1992 |
| EP | 0 500 253 | | 8/1992 |
| EP | 0511153 | A1 | 10/1992 |
| EP | 0 529 327 | | 3/1993 |
| EP | 0392125 | B1 | 3/1993 |
| EP | 0546824 | A1 | 6/1993 |
| EP | 0308143 | A1 | 11/1993 |
| EP | 0573943 | A1 | 12/1993 |
| EP | 0619504 | A1 | 10/1994 |
| EP | 0621136 | A2 | 10/1994 |
| EP | 0624353 | A3 | 11/1994 |
| EP | 0624354 | A3 | 11/1994 |
| EP | 0378378 | B1 | 1/1995 |
| EP | 0651069 | A1 | 5/1995 |
| EP | 0652301 | A1 | 5/1995 |
| EP | 0656458 | A3 | 6/1995 |
| EP | 0 661 470 | | 7/1995 |
| EP | 0396603 | B1 | 6/1996 |
| EP | 0388800 | B1 | 12/1996 |
| EP | 0 759 519 | | 2/1997 |
| EP | 0474369 | B1 | 3/1997 |
| EP | 0 818 622 | | 1/1998 |
| EP | 0652301 | B1 | 1/1998 |
| EP | 0826790 | A1 | 3/1998 |
| EP | 0842754 | A1 | 5/1998 |
| EP | 0 870 820 | | 10/1998 |
| EP | 0816112 | A3 | 10/1998 |
| EP | 0882759 | A1 | 12/1998 |
| EP | 0893677 | B1 | 1/1999 |
| EP | 0624353 | B1 | 2/1999 |
| EP | 0656458 | B1 | 2/1999 |
| EP | 0 905 221 | A1 | 3/1999 |
| EP | 0 905 419 | | 3/1999 |
| EP | 0647318 | B1 | 3/1999 |
| EP | 0651069 | B1 | 3/1999 |
| EP | 0 731 190 | B1 | 5/1999 |
| EP | 0949200 | A1 | 10/1999 |
| EP | 0845154 | B1 | 11/1999 |
| EP | 0624354 | B1 | 12/1999 |
| EP | 0582676 | B1 | 3/2000 |
| EP | 1063085 | A1 | 12/2000 |
| EP | 1 067 211 | | 1/2001 |
| EP | 0850126 | B1 | 1/2001 |
| EP | 1076087 | | 2/2001 |
| EP | 1078736 | A1 | 2/2001 |
| EP | 1109196 | A1 | 6/2001 |
| EP | 0778902 | B1 | 9/2001 |
| EP | 1 154 012 | | 11/2001 |
| EP | 0826790 | B1 | 11/2001 |
| EP | 1034320 | B1 | 12/2001 |
| EP | 0850133 | B1 | 1/2002 |
| EP | 0893677 | B1 | 1/2002 |
| EP | 1184480 | A2 | 3/2002 |
| EP | 1190791 | A3 | 4/2002 |
| EP | 1219464 | A2 | 7/2002 |
| EP | 1 233 054 | A1 | 8/2002 |
| EP | 0971812 | B1 | 10/2002 |
| EP | 1018291 | B1 | 10/2002 |
| EP | 1281513 | A2 | 2/2003 |
| EP | 1 300 608 | | 4/2003 |
| EP | 0950123 | B1 | 5/2003 |

| | | | | |
|---|---|---|---|---|
| EP | 0882759 | B1 | | 6/2003 |
| EP | 1 338 641 | | | 8/2003 |
| EP | 1340605 | A1 | | 9/2003 |
| EP | 1365141 | A1 | | 11/2003 |
| EP | 1083946 | B1 | | 12/2003 |
| EP | 1078736 | B1 | | 1/2004 |
| EP | 1378271 | A1 | | 1/2004 |
| EP | 0757615 | B1 | | 3/2004 |
| EP | 0842754 | B1 | | 3/2004 |
| EP | 1 411 145 | | | 4/2004 |
| EP | 0862395 | B1 | | 4/2004 |
| EP | 1 418 353 | A2 | | 5/2004 |
| EP | 1440775 | A1 | | 7/2004 |
| EP | 1445119 | A1 | | 8/2004 |
| EP | 1475557 | A1 | | 11/2004 |
| EP | 1481699 | A1 | | 12/2004 |
| EP | 1482190 | A2 | | 12/2004 |
| EP | 1498597 | A1 | | 1/2005 |
| EP | 1 510 594 | A2 | | 3/2005 |
| EP | 1311885 | B1 | | 3/2005 |
| EP | 1512781 | A2 | | 3/2005 |
| EP | 1183470 | B1 | | 4/2005 |
| FR | 2 669 689 | | | 5/1992 |
| GB | 768226 | | | 2/1957 |
| GB | 1005638 | | | 10/1988 |
| GB | 2338716 | | | 12/1999 |
| IE | 0990532 | A1 | | 3/2001 |
| JP | 52006318 | A | * | 1/1977 |
| JP | 62-111106 | | | 5/1987 |
| JP | 63-21209 | A2 | | 1/1988 |
| JP | 63-288994 | A2 | | 11/1988 |
| JP | 5-70879 | | | 3/1993 |
| JP | 5-36004 | U | | 5/1993 |
| JP | 5-42616 | U | | 6/1993 |
| JP | 6-264993 | | | 9/1994 |
| JP | 6-294307 | A | | 10/1994 |
| JP | 7-63135 | | | 3/1995 |
| JP | 7-90553 | A | | 4/1995 |
| JP | 7-103238 | | | 4/1995 |
| JP | 07-118832 | | | 5/1995 |
| JP | 7-41386 | A2 | | 10/1995 |
| JP | 7-286696 | | | 10/1995 |
| JP | 8-14014 | A | | 1/1996 |
| JP | 8-61499 | | | 3/1996 |
| JP | 9-20981 | A2 | | 1/1997 |
| JP | 253770 | A2 | | 9/1997 |
| JP | 10-088369 | A2 | | 4/1998 |
| JP | 10-265790 | | | 10/1998 |
| JP | 10-298440 | A2 | | 11/1998 |
| JP | 11-22423 | | | 1/1999 |
| JP | 11-190406 | | | 7/1999 |
| JP | 11-292629 | A2 | | 10/1999 |
| JP | 11-294118 | | | 10/1999 |
| JP | 11-333773 | A2 | | 12/1999 |
| JP | 2000-88104 | | | 3/2000 |
| JP | 2000-119843 | | | 4/2000 |
| JP | 2000-504089 | | | 4/2000 |
| JP | 2000297373 | A | * | 10/2000 |
| JP | 2000-327484 | | | 11/2000 |
| JP | 2000-339083 | | | 12/2000 |
| JP | 2001-62605 | | | 3/2001 |
| JP | 2001-64005 | | | 3/2001 |
| JP | 2001-93141 | A2 | | 4/2001 |
| JP | 2001-172766 | A2 | | 6/2001 |
| JP | 2001-192864 | | | 7/2001 |
| JP | 2001-280236 | | | 10/2001 |
| JP | 2001269938 | A | * | 10/2001 |
| JP | 2002-265968 | A2 | | 9/2002 |
| JP | 2002-309912 | | | 10/2002 |
| JP | 2002-332571 | | | 11/2002 |
| JP | 2003-13163 | | | 1/2003 |
| JP | 2003-13799 | | | 1/2003 |
| JP | 2003-28174 | A2 | | 1/2003 |
| JP | 2003-257117 | | | 1/2003 |
| JP | 2003-88939 | | | 3/2003 |
| JP | 2003-113941 | | | 4/2003 |
| JP | 2003-147508 | | | 5/2003 |
| JP | 2004-36788 | A2 | | 2/2004 |
| JP | 2005-68529 | A2 | | 3/2005 |
| RU | 2004586 | C1 | | 12/1993 |
| RU | 2153782 | C1 | | 7/2000 |
| SU | 1770350 | A1 | | 10/1992 |
| WO | WO 89/06707 | A1 | | 7/1989 |
| WO | WO 89/06708 | A1 | | 7/1989 |
| WO | WO 8906338 | A1 | | 7/1989 |
| WO | WO 92/02602 | | | 2/1992 |
| WO | WO 9206843 | A1 | | 4/1992 |
| WO | WO 9219425 | A2 | | 11/1992 |
| WO | WO 93/21288 | | | 10/1993 |
| WO | WO 93/21289 | | | 10/1993 |
| WO | WO 9324828 | A1 | | 12/1993 |
| WO | WO 95/20253 | A2 | | 7/1995 |
| WO | WO 95/29044 | A1 | | 11/1995 |
| WO | WO 95/29273 | A1 | | 11/1995 |
| WO | WO 95/31584 | A1 | | 11/1995 |
| WO | WO 96/04485 | | | 2/1996 |
| WO | WO 96/05333 | A1 | | 2/1996 |
| WO | WO 96/05942 | A1 | | 2/1996 |
| WO | WO 96/06961 | A1 | | 3/1996 |
| WO | WO 96/12389 | A1 | | 4/1996 |
| WO | WO 96/24488 | A1 | | 8/1996 |
| WO | WO 96/40446 | A1 | | 12/1996 |
| WO | WO 97/07531 | A1 | | 2/1997 |
| WO | WO 97/10093 | A1 | | 3/1997 |
| WO | WO 97/10940 | A1 | | 3/1997 |
| WO | WO 97/14555 | | | 4/1997 |
| WO | WO 97/16138 | A1 | | 5/1997 |
| WO | WO 98/12994 | A1 | | 4/1998 |
| WO | WO 98/13528 | A1 | | 4/1998 |
| WO | WO 98/47141 | A1 | | 10/1998 |
| WO | WO 98/02715 | A1 | | 1/1999 |
| WO | WO 99/09547 | A1 | | 2/1999 |
| WO | WO 99/12404 | A1 | | 3/1999 |
| WO | WO 99/14512 | A1 | | 3/1999 |
| WO | WO 99/16371 | A1 | | 4/1999 |
| WO | WO 99/22694 | A2 | | 5/1999 |
| WO | WO 99/27157 | A1 | | 6/1999 |
| WO | WO 99/29477 | A1 | | 6/1999 |
| WO | WO 99/31557 | A1 | | 6/1999 |
| WO | WO 99/34385 | A1 | | 7/1999 |
| WO | WO 99/46847 | A1 | | 9/1999 |
| WO | WO 99/54520 | A1 | | 10/1999 |
| WO | WO 99/54934 | A1 | | 10/1999 |
| WO | WO 99/57743 | A1 | | 11/1999 |
| WO | WO 99/62077 | A1 | | 12/1999 |
| WO | WO 99/62572 | A1 | | 12/1999 |
| WO | WO 00/22613 | A1 | | 4/2000 |
| WO | WO 00/24554 | A1 | | 5/2000 |
| WO | WO 00/25410 | A1 | | 5/2000 |
| WO | WO 00/28142 | A1 | | 5/2000 |
| WO | WO 00/33051 | A1 | | 6/2000 |
| WO | WO 00/35000 | A1 | | 6/2000 |
| WO | WO 00/44032 | A1 | | 7/2000 |
| WO | WO 00/47402 | A1 | | 8/2000 |
| WO | WO 00/55385 | A1 | | 9/2000 |
| WO | WO 00/56127 | A1 | | 9/2000 |
| WO | WO 00/56393 | A1 | | 9/2000 |
| WO | WO 00/62327 | A2 | | 10/2000 |
| WO | WO 00/68451 | A2 | | 11/2000 |
| WO | WO 00/75517 | A1 | | 12/2000 |
| WO | WO 00/78504 | A1 | | 12/2000 |
| WO | WO 01/05917 | | | 1/2001 |
| WO | WO 01/006033 | A1 | | 2/2001 |
| WO | WO 01/14736 | A1 | | 3/2001 |
| WO | WO 01/14745 | A1 | | 3/2001 |
| WO | WO 01/26862 | A1 | | 4/2001 |

| | | | |
|---|---|---|---|
| WO | WO 01/37631 | A2 | 5/2001 |
| WO | WO 01/40537 | A1 | 6/2001 |
| WO | WO 01/47451 | A1 | 7/2001 |
| WO | WO 01/59544 | A2 | 8/2001 |
| WO | WO 01/61182 | | 8/2001 |
| WO | WO 01/61719 | A1 | 8/2001 |
| WO | WO 01/62371 | A1 | 8/2001 |
| WO | WO 01/63639 | A1 | 8/2001 |
| WO | WO 01/67834 | A1 | 9/2001 |
| WO | WO 01/79583 | A2 | 10/2001 |
| WO | WO 01/80224 | A2 | 10/2001 |
| WO | WO 02/006875 | A1 | 1/2002 |
| WO | WO 02/13188 | A1 | 2/2002 |
| WO | WO 02/24601 | A1 | 3/2002 |
| WO | WO 02/24603 | A1 | 3/2002 |
| WO | WO 02/24970 | A2 | 3/2002 |
| WO | WO 02/32625 | A2 | 4/2002 |
| WO | WO 02/44440 | A1 | 6/2002 |
| WO | WO 02/054454 | A2 | 7/2002 |
| WO | WO 02/062714 | A2 | 8/2002 |
| WO | WO 02/073021 | | 9/2002 |
| WO | WO 02/080996 | A1 | 10/2002 |
| WO | WO 02/085237 | A2 | 10/2002 |
| WO | WO 02/090461 | A1 | 11/2002 |
| WO | WO 02/097289 | A1 | 12/2002 |
| WO | WO 03/009978 | A1 | 2/2003 |
| WO | WO 03/013990 | A1 | 2/2003 |
| WO | WO 03/020329 | A1 | 3/2003 |
| WO | WO 03/021731 | A1 | 3/2003 |
| WO | WO 03/031543 | A2 | 4/2003 |
| WO | WO 2003/046508 | A3 | 6/2003 |
| WO | WO 03/054876 | A1 | 7/2003 |
| WO | WO 03/076309 | A2 | 9/2003 |
| WO | WO 03/078679 | A1 | 9/2003 |
| WO | WO 03/091758 | A2 | 11/2003 |
| WO | WO 2003/095009 | A1 | 11/2003 |
| WO | WO 03/105134 | A1 | 12/2003 |
| WO | WO 2004/001804 | A2 | 12/2003 |
| WO | WO 2004/004998 | A1 | 1/2004 |
| WO | WO 2004/019809 | A2 | 3/2004 |
| WO | WO 2004/024206 | A1 | 3/2004 |
| WO | WO 2004/026359 | A1 | 4/2004 |
| WO | WO 2004/026500 | A2 | 4/2004 |
| WO | WO 2004/036169 | A1 | 4/2004 |
| WO | WO 2004/036292 | A2 | 4/2004 |
| WO | WO 2004/038701 | A2 | 5/2004 |
| WO | WO 2004/043631 | A1 | 5/2004 |
| WO | WO 2004/048126 | A2 | 6/2004 |
| WO | WO 2004/067466 | A1 | 8/2004 |
| WO | WO 2004/068530 | A1 | 8/2004 |
| WO | WO 2004/071670 | A1 | 8/2004 |
| WO | WO 2004/072959 | A2 | 8/2004 |
| WO | WO 2004/078424 | A2 | 9/2004 |
| WO | WO 2004/084773 | A1 | 10/2004 |
| WO | WO 2004/088113 | A1 | 10/2004 |
| WO | WO 2005/010596 | A2 | 2/2005 |
| WO | WO 2005/011744 | A2 | 2/2005 |
| WO | WO 2005/014760 | A1 | 2/2005 |
| WO | WO 2005/014882 | A1 | 2/2005 |
| WO | WO 2005/016620 | A2 | 2/2005 |
| WO | WO 2005/021851 | A1 | 3/2005 |
| WO | WO 2005/025844 | A1 | 3/2005 |
| WO | WO 2005/034791 | A1 | 4/2005 |
| WO | WO 2005/037144 | A2 | 4/2005 |
| WO | WO 2005/037985 | A2 | 4/2005 |
| WO | WO 2005/040451 | A1 | 5/2005 |
| WO | WO 2005/042064 | A1 | 5/2005 |
| WO | WO 2005/047737 | A1 | 5/2005 |

OTHER PUBLICATIONS

Japan Tribology Congress 1999 Proceedings, May 1999, pp. 11-12.

M. Kano et al., "The Effect of ZDDP and MODTC Additives on Friction Properties of DLC and Steel Cam Follower in Engine Oil", Abstracts of Papers from 2nd World Tribology Congress, Sep. 3-7, 2001, p. 342.

"Geometrical Product Specifications (GPS)—Surface texture: Profile method—Terms, definitions and surface texture parameters", Japanese Industrial Standard (JIS B 0601) Machine Elements, 2003, pp. 263-287.

"Petroleum products—Determination of base number—Perchloric acid potentiometric titration method", International Organization of Standardization (ISO 3771), Aug. 15, 1994, pp. 1-8.

"Standard Test Method for Separation of Representative Aromatics and Nonaromatics Fractions of High-Boiling Oils by Elution Chromatography", American Society for Testing and Materials (ASTM D 2549), 1995, pp. 895-900.

Von Dr.-Ing et al., "Neuartige Laufflächen-Schutzverfahren für Kolben von Verbrennungsmotoren", VDI-Zeitschrift Bd., Apr. 18, 1942, pp. 245-247, vol. 86, No. 15-16.

Gåhlin, Rickard et al., "ME-C:H Coatings in Motor Vehicles," *WEAR* 249, 2001, pp. 302-309.

Hershberger, J., et al., "Evaluation of DLC Coatings for Spark-Ignited, Direct-Injected Fuel Systems," *Surface & Coatings Technology*, 179, 2004, pp. 237-244.

Hershberger, J, et al., "Friction and Wear Behavior of Near-Frictionless Carbon Coatings in Formulated Gasolines," *Surface & Coating Technology*, 183, 2004, pp. 111-117.

Kovalchenko, A., et al., "Friction and Wear Performance of Low-Friction Carbon Coatings Under Oil Lubrication," Energy Technology Div., Argonne National Laboratory.

Ajayi, O., et al., "Effect of Carbon Coating on Scuffing Performance in Diesel Fuels," *Tribology Transactions*, vol. 44, 2001, pp. 298-304.

Ajayi, O., et al., Effect of Thin-Film Coating on Wear in EGR-Contaminated Oil, Energy Technology Div., Argonne National Laboratory.

Fujimori, N., et al., "Characterization of Conducting Diamond Films," *Vacuum*, vol. 36, Nos. 1-3, 1996, pp. 99-102.

Patent/Literature Search Report, Bawa Biotechnology Consulting, LLC, Jun. 3, 2005 (201 pages).

"Aluminium Alloy Die Castings," Japanese Industrial Standard (JIS H 5302), 2000, pp. 1-12.

"Aluminum Alloys Castings", Japanese Industrial Standard (JIS H 5202), 1999 (18 pages).

Japanese Industrial Standard, "Aluminium Alloy Castings", JIS H 5202, 1999, pp. 1910, 1911 and 1636-1647.

"Aluminum Alloy Die Castings," JIS H5302 (2000), pp. 1670-1681.

"Assessment of 2nd to 5th Order Irregularities of Surface Configuration by Means of Sections of Surfaces Definitions Relating to Reference System and Dimensions," DIN 4762, UDC 621-288:001.4 (Aug. 1960), pp. 1-4.

API Motor Oil Guide, "Which Oil is Right for You", American Petroleum Institute, Copyright 2002.

"Carbon Steels for Machine Structural Use", Japanese Industrial Standard (JIS G 4051), 1979, pp. 1381-1383.

"Carbon Steels for Machine Structural Use", Japanese Industrial Standard (JIS G 4051), 1979, pp. 1-10.

"Chromium Molybdenum Steels," Japanese Industrial Standard (JIS G 4105), 1979, pp. 1-11 (with Translation).

"Chromium Steels," Japanese Industrial Standard (JIS G 4104), 1979, pp. 1-9.

D.G. Watson et al., "Engineering Drawing Practice," XP002281300, University of Hertfordshire, Sep. 1991, p. 29, Figure 38.

Database WPI, Nov. 28, 2000, Derwent Publications, Ltd., AN 2000640583, XP002240184, JP 2000-327484, Nov. 28, 2000.

Dr. Marx, "Surfaces and Contact Mechanics", XP-002233233, Google, Retrieved from the Internet, Mar. 3, 2003, pp. 1-18.

Engine Oil Viscosity Classification—SAE J300 revised Apr. 1997, p. 133.
"Geometrical Product Specifications (GPS)—Surface Texture: Profile Method—Terms, Definitions and Surface Texture Parameters," International Standard, ISO 4287, TC 213 (1997), pp. 1-25.
"Grey iron castings", Japanese Industrial Standard (JIS G 5501), pp. 2075-2077.
Japanese Industrial Standard, "High Carbon Chromium Bearing Steels", JIS G 4805, 1999, pp. 1-31 (with translation).
International Standard "Application of Carbides for Machining by Chip Removal—Designation of the Main Groups of Chip Removal and Groups of Application," ISO 513, (1975), pp. 67-69.
Japanese Industrial Standard, "Structural Steels with Specified Hardenability Bands", JIS G 4052, 1979, pp. 2414, 2415, 1390-1403, 1410 and 1411.
JIS Japanese Industrial Standard; "Surface Roughness—Definitions and Designation"; JIS B 0601; 1994. (w/Translation).
JIS Japanese Industrial Standard; "Vickers Hardness Test—Test Method"; JIS Z 2244; 1998; (w/Translation).
Japanese Industrial Standard, 2001, No. B 0601.
K. Holmberg et al., "Tribological Characteristics of Diamond-like Carbon Coatings," VTT Symposium, Technical Research Centre of Finland, XP000570636, 1994, pp. 24-238.
Patent Abstracts of Japan, vol. 1996, No. 09, Sep. 30, 1996, JP 08-128448, May 21, 1996.
Patent Abstracts of Japan, vol. 2000, No. 01, Jan. 31, 2000, JP 11-287329, Oct. 19, 1999.
Patent Abstracts of Japan, vol. 2000, No. 09, Oct. 13, 2000, JP 2000-170768, Jun. 20, 2000.
PCT/IB2004/002552.
"Stainless Steel Bars", Japanese Industrial Standard (JIS G 4303), pp. 1457-1477.
"Standard Practice for Codification of Certain Nonferrous Metals and Alloys, Cast and Wrought1", ASTM International, Designation: B 275-02, Jun. 2002, pp. 1-7.
"Standard Test Method for Calibration and Operation of the Falex Block-on-Ring Friction and Wear Testing Machine", ASTM Designation: D2714—88, Jan. 1989, pp. 383-386.
Steve J. Bull et al., "High-Performance Diamond and Diamond-like Coatings", JOM, Apr. 1995, pp. 16-19, vol. 47, No. 4, XP 000500980.
Patent Abstracts of Japan, vol. 2003, No. 12, Dec. 5, 2003, JP 2004-155891, Jun. 3, 2004.
U.S. Appl. No. 10/911,741, filed May 5, 2004, Ueno.
Ronkainen, Helena, "Tribological Properties of Hydrogenated and Hydrogen-Free Diamond-Like Carbon Coatings," Disseration for the Degree of Doctor of Science in Technology, VTT Publications No. 434.

* cited by examiner

VALVE TRAIN FOR INTERNAL COMBUSTION ENGINE

CROSS-REFERENCE TO RELATED APPLICATIONS

This application has the following related applications: U.S. patent application Ser. No. 09/545,181 based on Japanese Patent Application Hei-11-102205 filed on Apr. 9, 1999; Ser. No. 10/468,713 which is the designated state (United States) application number of PCT Application JP02/10057 based on Japanese Patent Application 2001-117680 filed on Apr. 17, 2001; Ser. No. 10/355,099 based on Japanese Patent Application 2002-45576 filed on Feb. 22, 2002; Ser. No. 10/682,559 based on Japanese Patent Application No. 2002-302205 filed on Oct. 16, 2002; and Ser. No. 10/692,853 based on Japanese Patent Application 2002-322322 filed on Oct. 16, 2002.

BACKGROUND OF THE INVENTION

The present invention relates a valve train for an internal combustion engine, and more particularly to a valve train in which sliding portions of a camshaft and valves and/or counterparts thereof are coated with a hard carbon film (coating) such as a diamond-like carbon (DLC) film performing an excellent lower friction through a specified lubricating oil (lubricant).

Global environmental problems, such as global warming and ozone layer destruction, have been coming to the fore. It is said that the global warming is significantly effected by $CO_2$ emission. The reduction of $CO_2$ emission, notably the setting of $CO_2$ emission standards, has therefore become a big concern to each country.

One of challenges to reduce $CO_2$ emission is to improve vehicle fuel efficiency, and the sliding members of a vehicle engine and a lubricating oil thereof are largely involved in the improvements in vehicle fuel efficiency.

The material for the sliding members is required to have an excellent wear resistance and low friction coefficient even when heavily used as a sliding member of an internal combustion engine under a severe frictional and wearing condition. Lately, there have been developed the application of various hard film materials and the application of a locker arm with a build-in needle roller bearing, with respect to a follower member such as a valve lifter and a lifter shim.

In particular, a diamond-like carbon (DLC) material is expected to be useful as a coating material for the sliding member, because the DLC material provides a lower friction coefficient in material in the atmosphere and/or non-oil condition than that of another wear-resistant hard coating (film) material such as such as titanium nitride (TiN) and chromium nitride (CrN).

There are the following approaches to improving the vehicle efficiency in terms of the lubricating oil: (1) to decrease the viscosity of a lubricating oil in the sliding mechanism, thereby reducing viscous resistance in hydrodynamic lubrication regions and sliding resistance in the engine; and (2) to mix a suitable friction modifier and other additives into the lubricating oil so as to reduce friction losses under the conditions of mixed lubrication and boundary lubrication. Heretofore, researches have been made on an organomolybdenum compound, such as molybdenum dithiocarbamate (MoDTC) or molybdenum dithiophosphate (MoDTP), for use as the friction modifier and show that the lubricating oil containing such an organomolybdenum compound is effective in reducing friction when used for the steel sliding members.

Documents disclosed in Japan Tribology Congress 1999.5, Tokyo, Proceeding Page 11–12, KANO et.al. and in World Tribology Congress 2001.9, Vienna, Proceeding Page 342, KANO et.al. have reported friction characteristics of the DLC material and the performance of organomolybdenum compound used as a friction modifier. Further, Japanese Published Utility Model Applications No. 5-36004 and No. 5-42616, and Japanese Published Patent Application No. 8-14014 have proposed various improvements in an engine valve train.

SUMMARY OF THE INVENTION

However, it has been cleared that the DLC material does not provide such a low friction coefficient in the sliding members in the presence of lubricating oil and that the friction coefficient of the DLC material cannot be lowered to a sufficient degree even when used in combination with a lubricating oil containing organomolybdenum compound.

A valve train, particularly a camshaft and its surroundings, has had the problems that (1) a required torque for turning a camshaft is increased by an increase of a sliding resistance between cam lobes and valve lifters increases a required torque for turning a camshaft, and (2) the required torque for turning the camshaft also increased by an increase of sliding resistance between journal bearings of a cylinder head and camshaft journals.

Further, the valve train, particularly engine valves and their surroundings have had the problems that (1) it is difficult to further decease a clearance between a valve stem and a valve guide, (2) sticking or oil loss via valve guides will cause, if the lubrication of each valve stem is not sufficiently executed, (3) the reduction of a friction between a valve stem and a valve guide has almost reached a limit, and (4) a hammering of a valve against a valve seat of a cylinder head wears a valve face.

It is therefore an object of the present invention to provide a valve train that can attain excellent low-friction characteristics, high wear resistance, anti-seizing characteristic and durability by the combined use of a diamond-like carbon material and a lubricating oil, so that the valve train shows more improvements in vehicle fuel efficiency than that of the earlier technology.

The inventors of the present invention have found that a specified hard carbon film attained excellent low-friction characteristics, wear resistance, anti-seizing and durability under a condition that the hard carbon film is lubricated by a lubricating oil, specifically by a lubricating oil including an ashless friction modifier, attains, through intensive researches.

An aspect of the present invention resides in a valve train for an internal combustion engine, comprising: a lubricating oil; a camshaft made of an iron-based material and comprising a cam lobe and a camshaft journal, the camshaft slidingly moving on a counterpart thereof through the lubricating oil; and a hard carbon film formed on at least one of a sliding portion of the camshaft and the counterpart made of an ironbased material, a hydrogen amount of the hard carbon film being 10 atomic percent or less.

The other objects and features of this invention will become understood from the following description with reference to the accompanying drawings.

DETAILED DESCRIPTION OF THE INVENTION

Figure 1:
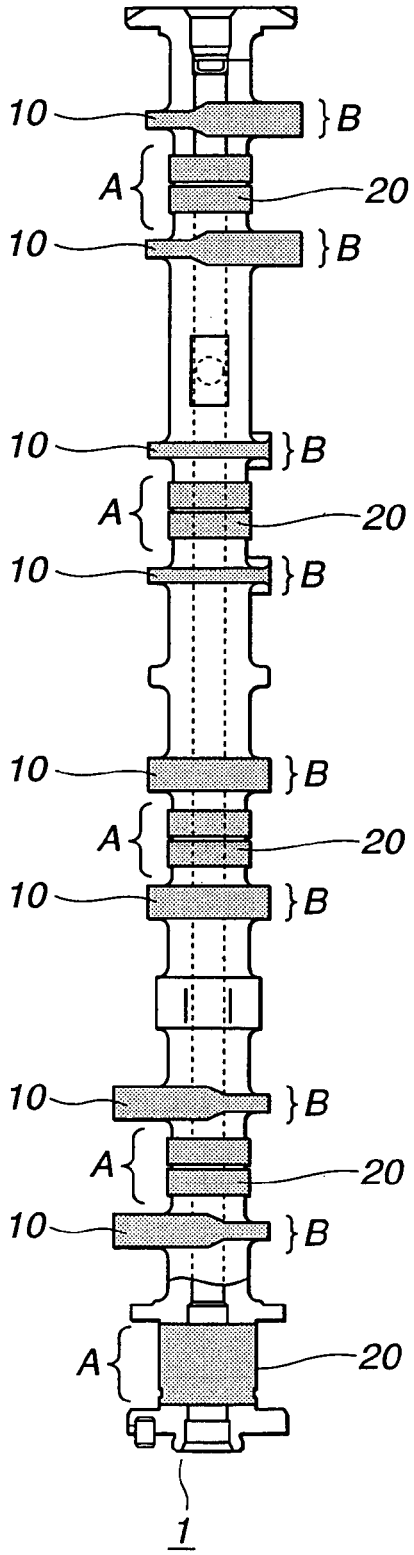
FIG. 1 is a side view showing a camshaft of a valve train for an internal combustion engine in accordance with the present invention.

The present invention will be described below in detail. In the following description, all percentages (%) are by mass unless otherwise specified.

Referring to the drawings, there is discussed a valve train including a camshaft in accordance with the present invention.

Figure 2:
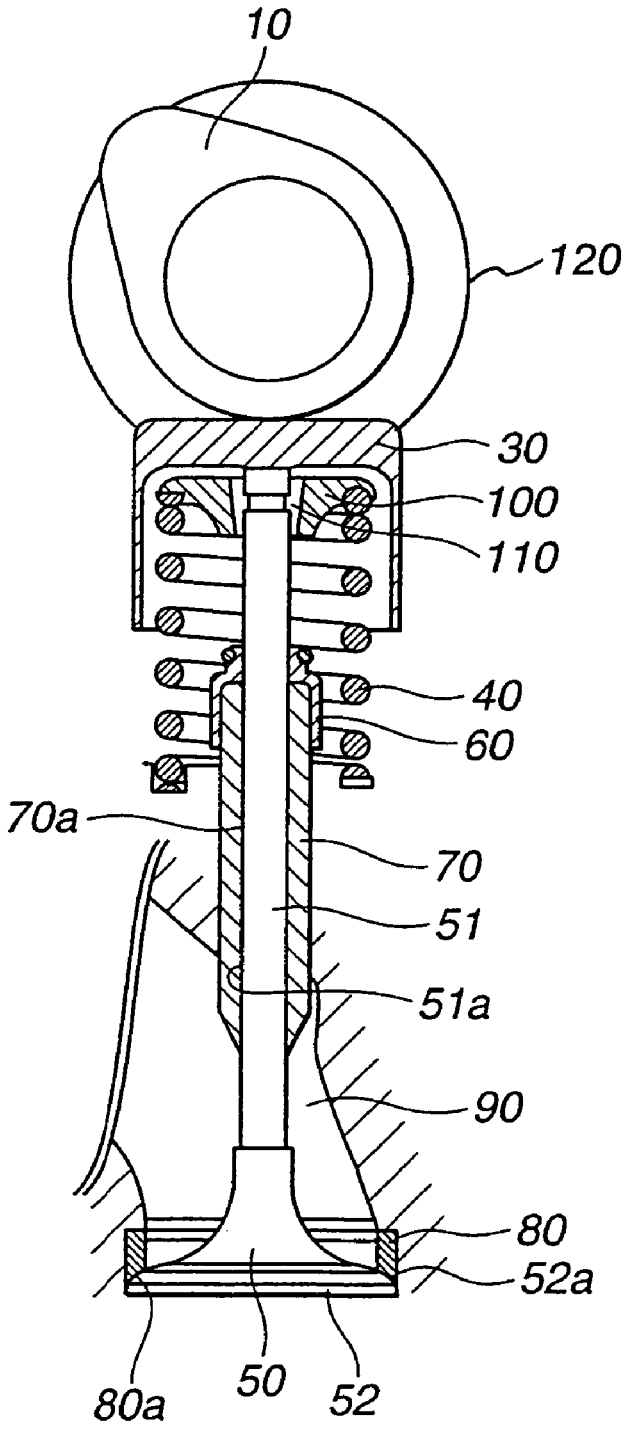
FIG. 2 is a cross sectional view of the valve train according to the present invention.

As shown in FIGS. 1 and 2, a camshaft 1 made of an iron-based material comprises cam lobes 19 and camshaft journals 20. Camshaft 1 turns by receiving a driving torque of an internal combustion engine (not shown) through a crankshaft (not shown) and a chain (not shown). Each cam lobes 10 pushes down each valve lifter 30 according to the revolution of camshaft 1 to execute opening and closing operation of each valve 50.

Camshaft 1 turns under a supported condition that camshaft journals 20 of camshaft 1 are supported by cylinder head brackets 120, respectively. Lubricating oil is supplied to a small clearance formed between each camshaft journal 20 and each cylinder head bracket 120 so as to smoothen the sliding motion between each camshaft journal 20 and each cylinder head bracket 120.

When each valve 50 corresponding to each cam lobe 10 is opened and closed according to the reciprocating motion of each valve lifter 30, large sliding resistance is generated between each cam lobe 10 and each valve lifter 30 due to the reaction force of each valve spring 40. A required torque for turning, camshaft 1 is, therefore, a sum of a necessary torque for pushing down each valve 50 against the reaction force of each valve spring 40 and a driving torque for turning camshaft 1 against the friction resistance of each sliding portion.

A hard carbon film is formed on a sliding surface of each cam lobe 10 denoted by B in FIG. 1 and/or a counter sliding surface of each valve lifter 30 to decrease a friction coefficient between the sliding surfaces. Further, the hard carbon film is also formed on a sliding surface of each camshaft journal 10 denoted by B in FIG. 1 and/or a corresponding sliding surface of each cylinder head bracket 120 to decrease a friction coefficient between the sliding surfaces. These arrangements reduce the friction between cam lobe 10 and valve lifter 30 and the friction between camshaft journal 20 and cylinder head bracket 120 are reduced, and thereby reducing the total torque for turning camshaft 1. Consequently, an engine response is improved. Further, the wear resistance at the sliding portions is improved and therefore the durability of the sliding portions of the valve train. Further, since the anti-seizing of the sliding portions of the valve train is also improved, it is possible to decrease a clearance between the sliding portion, and therefore it becomes possible to suppress insufficient oil supply to the clearance.

Subsequently, there is explained the engine valve system and its surrounds of the valve train according to the present invention, with reference to FIG. 2.

As shown in FIG. 2, according to the turning of cam lobe 10, valve lifter 30 is pushed down while valve spring 40 is compressed. Simultaneously, valve 50 is pushed down along a valve guide 70 having a stem seal 60, and therefore valve 50 is released from a valve seat 80 so as to communicate an intake port 80 with an engine combustion chamber (not shown). Thereafter, according to the further turning of cam lobes 10, valve 50 together with valve lifter 30, a retainer 100 and a cotter 110 is pushed up due to the reaction force of valve spring 40, so that valve 50 is contacted with valve seat 80 so as to shut off a communicate between intake port 80 with engine combustion chamber (not shown). The thus valve opening and closing operation is executed in synchronization with the turning of cam lobe 10.

Stem 51 of valve 50 is built in a cylinder head (not shown) by passing through valve guide 70 press-fitted in the cylinder head while being lubricated. A valve face 52 of valve 50 continuously hits a valve seat 80 press-fitted at an inlet port end of the cylinder head when the engine is operating.

A hard carbon film is formed on sliding surface 51*a* of each valve stem 51 and/or a counter sliding surface 70*a* of each valve guide 70. Therefore, the wear resistance of the sliding portions of each valve stem 52 and each valve guide 70 is improved, and the durability of the valve train is improved. Further, anti-seizing of the sliding portions is also improved, and therefore it becomes possible to decrease a clearance between valve stem 51 and valve guide 70 so as to suppress the oil loss via valve guide 70.

The hard carbon film is also formed on a sliding surface 52*a* of each valve face 52 and/or a counter sliding surface 80*a* of each valve seat 80. Therefore, the wear resistance of the sliding portions of each valve face 52 and each valve seat 80 is improved, and the durability of the valve train is improved.

In this embodiment according to the present invention, the iron-based material used for parts of the valve train is not particularly limited, and may be selected from cast-iron and steel according to the required performances and conditions.

The hard carbon film is generally in the amorphous form of carbon in which carbon exists in both $sp^2$ and $sp_3$ hybridizations to have a composite structure of graphite and diamond. More specifically, the hard carbon film is made of hydrogen-free amorphous carbon (a-C), hydrogen-containing amorphous carbon (a-C:H) and/or metal containing diamond-like carbon (DLC) that contains as a part a metal element of titanium (Ti) or molybdenum (Mo). The hydrogen-free amorphous carbon and the amorphous carbon low in hydrogen content are referred to as "diamond-like carbon (DLC)".

Since the friction coefficient increases according to the increase of the hydrogen amount in the hard carbon film, it is necessary that the hydrogen amount in the hard carbon film is 10 atom % (atomic percent) or less, and more preferably 1 atom % or less, so as to ensure a further stable sliding performance under the a lubricating oil existing condition. Such a hard carbon film can be formed by a physical vapor deposition (PVD) process or a chemical vapor deposition (CVD) process, or a combination thereof. The production process of the hard carbon film is not specifically limited as far as the hard carbon film is form on desired portions. One of representative production processes is an arc ion plating process.

It is preferable that a surface roughness Ra of a sliding surface of a part in the valve train, which has not yet been coated with the hard carbon film, is 0.03 μm or less, in view of a sliding stability. It is not preferable that the surface roughness Ra becomes greater than 0.03 μm since there is a possibility that scuffing is partially formed under such a surface roughness condition so as to largely increase the friction coefficient. The surface roughness Ra is explained as $Ra_{75}$ in JIS (Japanese Industrial Standard) B0601(:2001).

Subsequently, there is discussed the lubricating oil of the valve train according to the present invention.

The lubricating oil is used for the valve train in accordance with the present invention. The lubricating oil composition includes a base oil and at least one of an ashless fatty-ester friction modifier, an ashless aliphatic-amine friction modifier, polybutenyl succinimide, a derivative of polybutenyl succinimide and zinc dithiophosphate.

The base oil is not particularly limited, and can be selected from any commonly used base oil compounds, such as mineral oils, synthetic oils and fats.

Specific examples of the mineral oils include normal paraffins and paraffin-based or naphthenebased oils each prepared by extracting lubricating oil fractions from petroleum by atmospheric or reduced-pressure distillation, and then, purifying the obtained lubricating oil fractions with at least one of the following treatments: solvent deasphalting, solvent extraction, hydrocracking, solvent dewaxing, hydrorefining, wax isomerization, surfuric acid treatment and clay refining.

Although it is general to use the mineral oil prepared by solvent purifying and/or hydro-refining, it is further preferable that the mineral oil is produced by an advanced hydrocracking process capable of further easily decreasing aromatic compounds or an isomerization of GTL Wax (Gas To Liquid Wax).

Specific examples of the synthetic oils include: poly-α-olefins (PAO), such as 1-octene oligomer, 1-decene oligomer and ethylene-propylene oligomer, and hydrogenated products thereof; isobutene oligomer and a hydrogenated product thereof; isoparaffines; alkylbenzenes; alkylnaphthalenes; diesters, such as ditridecyl glutarate, dioctyl adipate, diisodecyl adipate, ditridecyl adipate and dioctyl sebacate; polyol esters, such as trimethylolpropane esters (e.g. trimethylolpropane caprylate, trimetylolpropane pelargonate and trimethylolpropane isostearate) and pentaerythritol esters (e.g. pentaerythritol-2-ethyl hexanoate and pentaerythritol pelargonate); polyoxyalkylene glycols; dialkyl diphenyl ethers; and polyphenyl ethers. Among these synthetic oil compounds, preferred are poly-α-olefins, such as 1-octene oligomer and 1-decene oligomer, and hydrogenated products thereof.

The above-mentioned base oil compounds can be used alone or in combination thereof. In the case of using as the base oil a mixture of two or more of the above base oil compounds, there is no particular limitation to the mixing ratio of the base oil compounds.

The sulfur content of the base oil is not particularly restricted, and is preferably 0.2% or less, more preferably 0.1% or less, still more preferably 0.05% or lower, based on the total mass of the base oil. It is desirable to use the hydro-refined mineral oil or the synthetic oil because the hydro-refined mineral oil and the synthetic oil each has a sulfur content of not more than 0.005% or substantially no sulfur content (not more than 5 ppm).

The aromatics content of the base oil is not also particularly restricted. Herein, the aromatics content is defined as the amount of an aromatics fraction determined according to ASTM D2549. In order for the lubricating oil composition to maintain low-friction characteristics over time, the aromatic content of the base oil is preferably 15% or less, more preferably 10% or less, and still more preferably 5% or less, based on the total mass of the base oil. The lubricating oil composition undesirably deteriorates in oxidation stability when the aromatics content of the base oil exceeds 15%.

The kinematic viscosity of the base oil is not particularly restricted. When the lubricating oil composition is for use in the internal combustion engine, the kinematic viscosity of the base oil is preferably 2 $mm^2/s$ or higher, more preferably 3 $mm^2/s$ or higher, and, at the same time, is preferably 20 $mm^2/s$ or lower, more preferably 10 $mm^2/s$ or lower, still more preferably 8 $mm^2/s$ or lower, as measured at 100° C. When the kinematic viscosity of the base oil is lower than 2 $mm^2/s$ at 100° C., there is a possibility that the lubricating oil composition fails to provide sufficient wear resistance and causes a considerable evaporation loss. When the kinematic viscosity of the base oil exceeds 20 $mm^2/s$ at 100° C., there is a possibility that the lubricating oil composition fails to provide low-friction characteristics and deteriorates in low-temperature performance. In the case of using two or more of the above-mentioned base oil compounds in combination, it is not necessary to limit the kinematic viscosity of each base oil compound to within such a specific range so long as the kinematic viscosity of the mixture of the base oil compounds at 100° C. is in the above-discussed preferable range.

The viscosity index of the base oil is not particularly restricted, and is preferably 80 or higher, more preferably 100 or higher, most preferably 120 or higher, in case that it is used as a lubricating oil for the internal combustion engine. By heightening the viscosity index of the base oil, the engine lubricating oil using such base oil attains improved oil-consumption performance, low-temperature viscosity characteristics and improved fuel combustion performance.

As the fatty-ester friction modifier and the aliphatic-mine friction modifier, there may be used fatty acid esters and/or aliphatic amines each having $C_6$–$C_{30}$ straight or branched hydrocarbon chains, preferably $C_8$–$C_{24}$ straight or branched hydrocarbon chains, more preferably $C_{10}$–$C_{20}$ straight or branched hydrocarbon chains. When the carbon number of the hydrocarbon chain of the friction modifier is not within the range of 6 to 30, there arises a possibility of failing to produce a desired friction reducing effect.

Specific examples of the $C_6$–$C_{30}$ straight or branched hydrocarbon chain include: alkyl groups, such as hexyl, heptyl, octyl, nonyl, decyl, undecyl, dodecyl, tridecyl, tetradecyl, pentadecyl, hexadecyl, heptadecyl, octadecyl, nonadecyl, icosyl, heneicosyl, docosyl, tricosyl, tetracosyl, pentacosyl, hexacosyl, heptacosyl, octacosyl, nonacosyl and triacontyl; and alkenyl groups, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, heneicosenyl, docosenyl, tricosenyl, tetracosenyl, pentacosenyl, hexacosenyl, heptacosenyl, octacosenyl, nonacosenyl and triacontenyl. The above alkyl and alkenyl groups include all possible isomers such as straight or branched hydrocarbon chain structures and double-bond isomerism of alkenyl group.

The fatty acid ester is exemplified by esters of fatty acids having the above $C_6$–$C_{30}$ hydrocarbon groups and monofunctional aliphatic alcohols or aliphatic polyols. Specific examples of such fatty acid esters include glycerol monooleate, glycerol dioleate, sorbitan monooleate and sorbitan dioleate.

The aliphatic amine is exemplified by aliphatic monoamines and alkylene oxide adducts thereof, aliphatic polyamines, imidazolines and derivatives thereof each having the above $C_6$–$C_{30}$ hydrocarbon groups.

Specific examples of such aliphatic amines include: aliphatic amine compounds, such as laurylamine, lauryldiethylamine, lauryldiethanolamine, dodecyldipropanolamine, palmitylamine, stearylamine, stearyltetraethylenepentamine, oleylamine, oleylpropylenediamine, oleyldiethanolamine and N-hydroxyethyloleylimidazolyne; alkylene oxide adducts of the above aliphatic amine compounds, such as N,N-dipolyoxyalkylene-N-alkyl or alkenyl ($C_6$–$C_{28}$) amines; and acid-modified compounds prepared by reacting the above aliphatic amine compounds with $C_2$–$C_{30}$ monocarboxylic acids (such as fatty acids) or $C_2$–$C_{30}$ polycarboxylic acids (such as oxalic acid, phthalic acid, trimellitic acid and pyromellitic acid) so as to neutralize or amidate the whole or part of the remaining amino and/or imino groups. Above all, N,N-dipolyoxyethylene-N-oleylamine is preferably used.

The amount of the fatty-ester friction modifier and/or the aliphatic-amine friction modifier contained in the lubricating oil composition is not particularly restricted, and is preferably 0.05 to 3.0%, more preferably 0.1 to 2.0%, and most preferably 0.5 to 1.4%, based on the total mass of the lubricating oil. When the amount of the fatty-ester friction modifier and/or the aliphatic-mine friction modifier in the lubricating oil composition is less than 0.05%, there is a possibility of failing to obtain a sufficient friction reducing effect. When the amount of the fatty-ester friction modifier and/or the aliphatic-amine friction modifier in the lubricating oil composition exceeds 3.0%, there is a possibility that the solubility of the friction modifier or modifiers in the base oil becomes so low that the lubricating oil composition deteriorates in storage stability to cause precipitations.

As the polybutenyl succinimide, there may be used compounds represented by the following general formulas (1) and (2).

(1)

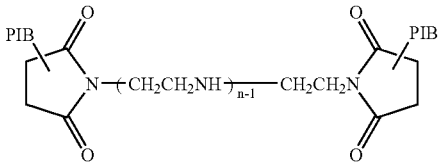

(2)

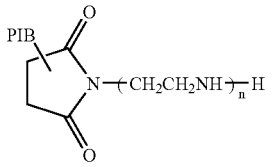

In the formulas (1) and (2), PIB represents a polybutenyl group derived from polybutene having a number-average molecular weight of 900 to 3,500, preferably 1,000 to 2,000, that can be prepared by polymerizing high-purity isobutene or a mixture of 1-butene and isobutene in the presence of a boron fluoride catalyst or aluminum chloride catalyst. When the number-average molecular weight of the polybutene is less than 900, there is a possibility of failing to provide a sufficient detergent effect. When the number-average molecular weight of the polybutene exceeds 3,500, the polybutenyl succinimide tends to deteriorate in low-temperature fluidity.

The polybutene may be purified, before used for the production of the polybutenyl succinimide, by removing trace amounts of fluorine and chlorine residues resulting from the above polybutene production catalyst with any suitable treatment (such as adsorption process or washing process) in such a way as to control the amount of the fluorine and chlorine residues in the polybutene to 50 ppm or less, desirably 10 ppm or less, more desirably 1 ppm or less. Further, n represents an integer of 1 to 5, preferably 2 to 4, in the formulas (1) and (2) in view of the detergent effect.

The production method of the polybutenyl succinimide is not particularly restricted. For example, the polybutenyl succinimide can be prepared by reacting a chloride of the polybutene, or the polybutene from which fluorine and chlorine residues are sufficiently removed, with maleic anhydride at 100 to 200° C. to form polybutenyl succinate, and then, reacting the thus-formed polybutenyl succinate with polyamine (such as diethylene triamine, triethylene tetramine, tetraethylene pentamine or pentaethylene hexamine).

As the polybutenyl succinimide derivative, there may be used boron- or acid-modified compounds obtained by reacting the polybutenyl succinimides of the formula (1) or (2) with boron compounds or oxygen-containing organic compounds so as to neutralize or amidate the whole or part of the remaining amino and/or imide groups. Among them, boron-containing polybutenyl succinimides, especially boron-containing bis(polybutenyl)succinimide, are preferably used. The content ratio (B/N) between nitrogen and boron by mass in the boron-containing polybutenyl succinimide compound is usually 0.1 to 3, preferably 0.2 to 1.

The boron compound used for producing the above polybutenyl succinimide derivative can be a boric acid, a borate or a boric acid ester. Specific examples of the boric acid include orthoboric acid, metaboric acid and tetraboric acid. Specific examples of the borate include: ammonium salts, such as ammonium borates, e.g., ammonium metaborate, ammonium tetraborate, ammonium pentaborate and ammonium octaborate. Specific examples of the boric acid ester include: esters of boric acids and alkylalcohols (preferably $C_1$–$C_6$ alkylalcohols), such as monomethyl borate, dimethyl borate, trimethyl borate, monoethyl borate, diethyl borate, triethyl borate, monopropyl borate, dipropyl borate, tripropyl borate, monobutyl borate, dibutyl borate and tributyl borate.

The oxygen-containing organic compound used for producing the above polybutenyl succinimide derivative can be any of $C_1$–$C_{30}$ monocarboxylic acids, such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid and eicosanoic acid; $C_2$–$C_{30}$ polycarboxylic acids, such as oxalic acid, phthalic acid, trimellitic acid and pyromellitic acid, and anhydrides and esters thereof; $C_2$–$C_6$ alkylene oxides; and hydroxy(poly)oxyalkylene carbonates.

The amount of the polybutenyl succinimide and/or polybutenyl succinimide derivative contained in the lubricating oil composition is not particularly restricted, and is preferably 0.1 to 15%, more preferably 1.0 to 12%, based on the total mass of the lubricating oil. When the amount of the polybutenyl succineimide and/or polybutenyl succinimide derivative in the lubricating oil composition is less than 0.1%, there is a possibility of failing to attain a sufficient detergent effect. When the amount of the polybutenyl succineimide and/or polybutenyl succinimide derivative in the lubricating oil composition exceeds 15%, the lubricating oil composition may deteriorate in demulsification ability. In addition, there is a possibility of failing to obtain a detergent effect commensurate with the amount of the polybutenyl succineimide and/or polybutenyl succinimide derivative in the lubricating oil composition.

As the zinc dithiophosphate, there may be used compounds represented by the following general formula (3).

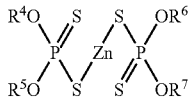

(3)

In the general formula (3), $R^4$, $R^5$, $R^6$ and $R^7$ each represent $C_1$–$C_{24}$ hydrocarbon groups. The $C_1$–$C_{24}$ hydrocarbon group is preferably a $C_1$–$C_{24}$ straight-chain or branched-chain alkyl group, a $C_3$–$C_{24}$ straight-chain or branched-chain alkenyl group, a $C_5$–$C_{13}$ cycloalkyl or straight- or branched-chain alkylcycloalkyl group, a $C_6$–$C_{18}$ aryl or straight- or branched-chain alkylaryl group, or a $C_7$–$C_{19}$ arylalkyl group. The above alkyl group or alkenyl group can be primary, secondary or tertiary.

Specific examples of $R^4$, $R^5$, $R^6$ and $R^7$ include: alkyl groups, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl and tetracosyl; alkenyl groups, such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl (oleyl), nonadecenyl, icosenyl, heneicosenyl, docosenyl, tricosenyl and tetracosenyl; cycloalkyl groups, such as cyclopentyl, cyclohexyl and cycloheptyl; alkylcycloalkyl groups, such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, di-propylcyclopentyl, propylethylmethylcyclopentyl, methylcyclohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, di-propylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, di-propylcycloheptyl and propylethylmethylcycloheptyl; aryl groups, such as phenyl and naphthyl; alkylaryl groups, such as tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl and dodecylphenyl; and arylalkyl groups, such as benzyl, methylbenzyl, dimethylbenzyl, phenethyl, methylphenethyl and dimethylphenethyl. The above hydrocarbon groups include all possible isomers. Above all, preferred are a $C_1$–$C_{18}$ straight- or branched-chain alkyl group and a $C_6$–$C_{18}$ aryl or straight- or branched-chain alkylaryl group.

The zinc dithiophosphate is exemplified by zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-octyldithiophosphate, zinc di-2-ethylhexyldithiophosphate, zinc di-n-decyldithiophosphate, zinc di-n-dodecyldithiophosphate and zinc diisotridecyldithiophosphate.

The amount of the zinc dithiophosphate contained in the lubricating oil composition is not particularly restricted. In order to obtain a larger friction reducing effect, the zinc dithiophosphate is preferably contained in an amount of 0.1 % or less, more preferably in an amount of 0.06% or less, most preferably in a minimum effective amount, in terms of the phosphorus element based on the total mass of the lubricating oil composition. When the amount of the zinc dithiophosphate in the lubricating oil composition exceeds 0.1%, there is a possibility of inhibiting the friction reducing effect of the ashless fatty-ester friction modifier and/or the ashless aliphatic-mine friction modifier at the sliding surfaces of the member covered with the hard carbon film and the ironbased material member.

The production method of the zinc dithiophosphate is not particularly restricted, and the zinc dithiophosphate can be prepared by any known method. For example, the zinc dithiophosphate may be prepared by reacting alcohols or phenols having the above $R^4$, $R^5$, $R^6$ and $R^7$ hydrocarbon groups with phosphorous pentasulfide ($P_2O_5$) to form dithiophosphoric acid, and then, neutralizing the thus-formed dithiophosphoric acid with zinc oxide. It is noted that the molecular structure of zinc dithiophosphate differs according to the alcohols or phenols used as a raw material for the zinc dithiophosphate production.

The above-nentioned zinc dithiophosphate compounds can be used alone or in the form of a mixture of two or more thereof. In the case of using two or more of the above zinc dithiophosphate compounds in combination, there is no particular limitation to the mixing ratio of the zinc dithiophosphate compounds.

The above-described lubricating oil composition provides a greater friction reducing effect especially when the thus lubricating oil is used for lubricating the sliding surfaces of the member covered with the hard carbon film and the counterpart member formed of an d-based material.

In order to improve the performance required of the lubricating oil composition used for engine lubricating oil, the lubricating oil composition may further include any other additive or additives, such as a metallic detergent, an antioxidant, a viscosity index improver, a friction modifier other than the above-mentioned fatty-ester friction modifier and aliphatic-amine friction modifier, an ashless dispersant other than the above-mentioned polybutenyl succinimide and polybutenyl succinimide derivative, an anti-wear agent or extreme-pressure agent, a rust inhibitor, a nonionic surfactant, a demulsifier, a metal deactivator and/or an anti-foaming agent.

The metallic detergent can be selected from any metallic detergent compound commonly used for engine lubricating oil. Specific examples of the metallic detergent include sulfonates, phenates and salicylates of alkali metals, such as sodium (Na) and potassium (K), or of alkali-earth metals, such as calcium (Ca) and magnesium (Mg); and a mixture of two or more thereof. Among others, sodium and calcium sulfonates, sodium and calcium phenates, and sodium and calcium salicylates are suitably used. The total base number and amount of the metallic detergent can be selected in accordance with the performance required of the lubricating oil composition. The total base number of the metallic detergent is usually 0 to 500 mgKOH/g, preferably 150 to 400 mgKOH/g, as measured by perchloric acid method according to ISO 3771. The amount of the metallic detergent is usually 0.1 to 10% based on the total mass of the lubricating oil composition.

The antioxidant can be selected from any antioxidant compounds commonly used for engine lubricating oil. Specific examples of the antioxidant include: phenolic antioxidants, such as 4,4'-methylenebis(2,6di-tertbutylphenol) and octadecyl-3-(3,5-di-tert-butyl-4-hydroxyphenyl)propionate; amino antioxidants, such as phenyl-α-naphthylamine, alkylphenyl-α-naphthylamine and alkyldiphenylamine; and mixtures of two or more thereof. The amount of the antioxidant is usually 0.01 to 5% based on the total mass of the lubricating oil composition.

As the viscosity index improver, there may be used: non-dispersion type polymethacrylate viscosity index improvers, such as copolymers of one or more kinds of methacrylates and hydrogenated products thereof; dispersion type polymethacrylate viscosity index improvers, such as copolymers of methacrylates further including nitrogen compounds; and other viscosity index improvers, such as copolymers of ethylene and α-olefins (e.g. propylene, 1-butene and 1-pentene) and hydrogenated products thereof, polyisobutylenes and hydrogenated products thereof, styrene-diene hydrogenated copolymers, styrene-maleate anhydride copolymers and polyalkylstyrenes. The molecular weight of the viscosity index improver needs to be selected in view of the shear stability. For example, the number-average molecular weight of the viscosity index improver is desirably in a range of 5,000 to 1,000,000, more desirably 100,000 to 800,000, for the dispersion or non-dispersion type polymethacrylates; in a range of 800 to 5,000 for the polyisobutylene or hydrogenated product thereof; and in a range of 800 to 300,000, more desirably 10,000 to 200,000 for the ethylene/α-olefin copolymer or hydrogenated product thereof. The above viscosity index improving compounds can be used alone or in the form of a mixture of two or more thereof. The amount of the viscosity index improver is preferably 0.1 to 40.0% based on the total mass of the lubricating oil composition.

The friction modifier other than the above-mentioned fatty-ester friction modifier and aliphatic-amine friction modifier can be any of ashless friction modifiers, such as boric acid esters, higher alcohols and aliphatic ethers, and metallic friction modifiers, such as molybdenum dithiophosphate, molybdenum dithiocarbamate and molybdenum disulfide.

The ashless dispersant other than the above-mentioned polybutenyl succinimide and polybutenyl succinimide derivative can be any of polybutenylbenzylamines and polybutenylamines each having polybutenyl groups of which the number-average molecular weight is 900 to 3,500, polybutenyl succinimides having polybutenyl groups of which the number-average molecular weight is less than 900, and derivatives thereof.

As the anti-friction agent or extreme-pressure agent, there may be used: disulfides, sulfurized fats, olefin sulfides, phosphate esters having one to three $C_2$–$C_{20}$ hydrocarbon groups, thiophosphate esters, phosphite esters, thiophosphite esters and amine salts of these esters.

As the rust inhibitor, there may be used: alkylbenzene sulfonates, dinonylnaphthalene sulfonates, esters of alkenylsuccinic acids and esters of polyalcohols.

As the nonionic surfactant and demulsifier, there may be used: noionic polyalkylene glycol surfactants, such as polyoxyethylene alkylethers, polyoxyethylene alkylphenylethers and polyoxyethylene alkylnaphthylethers. The metal deactivator can be exemplified by imidazolines, pyrimidine derivatives, thiazole and benzotriazole.

The anti-foaming agent can be exemplified by silicones, fluorosilicones and fluoroalkylethers.

Each of the friction modifier other than the fatty-ester and aliphatic-amine friction modifiers, the ashless dispersant other than the polybutenyl succinimide and polybutenyl succinimide derivative, the anti-wear agent or extreme-pressure agent, the rust inhibitor and the demulsifier is usually contained in an amount of 0.01 to 5% based on the total mass of the lubricating oil composition, the metal deactivator is usually contained in an amount of 0.005 to 1% based on the total mass of the lubricating oil composition, and the anti-foaming agent is usually contained in an amount of 0.0005 to 1% based on the total mass of the lubricating oil composition.

With the thus arranged valve train used under the specified lubricating oil existing condition in accordance with the present invention, the sliding portions of camshaft 1, valves 50 and their surroundings and/or counterparts thereof are coated with the hard carbon film such as diamond-like carbon (DLC) film, which attains extremely exellent low friction when used through the specified lubricating oil. Accordingly, when the valve train is used under the specified lubricating oil existing condition, the low friction characteristics, wear resistance, anti-seizing and durability of the sliding portions of the valve train is largely improved. These improvements provide the improvements in efficiency and reliability of internal combustion engines and consequently largely improves the fuel consumption efficiency of the engines.

This application is based on Japanese Patent Application No. 2003-206671 filed on Aug. 8, 2003 in Japan. The entire contents of this Japanese Patent Application are incorporated herein by reference.

Although the invention has been described above by reference to certain embodiments of the invention, the invention is not limited to the embodiments described above. Modifications and variations of the embodiments described above will occur to those skilled in the art, in light of the above teaching. The scope of the invention is defined with reference to the following claims.

What is claimed is:

1. A valve train for an internal combustion engine, comprising:

a lubricating oil comprising a fatty-ester friction modifier or an aliphatic-amine friction modifier;

a camshaft made of an iron-based material and comprising a cam lobe and a camshaft journal, the camshaft slidingly moving on a counterpart thereof through the lubricating oil; and a hard carbon film formed on at least one of a sliding portion of the camshaft and the counterpart made of an iron-based material, wherein the hard carbon film is made of hydrogen-free amorphous carbon (a-c) and is a diamond-like carbon film produced by arc ion plating process.

2. The valve train as claimed in claim 1, further comprising a valve made of iron-based material, the hard carbon film being formed on at least a sliding surface of the valve and a sliding surface of a counter part thereof made of iron-based material.

3. The valve train as claimed in claim , wherein a surface roughness Ra of the sliding portion which is not yet coated with the hard carbon film is smaller than or equal to 0.03 μm.

4. The valve train as claimed in claim 1, wherein the fatty-ester friction modifier and the aliphatic-amine friction modifier each have $C_6$–$C_{30}$ hydrocarbon chain, and the amount of the fatty-ester friction modifier and/or the aliphatic-amine friction modifier contained in the lubricating oil is 0.05 to 3.0% based on the total mass of the lubricating oil.

5. The valve train as claimed in claim 1, wherein the lubricating oil includes at least one of polybutenyl succinimide and polybutenyl succinimide derivative.

6. The valve train as claimed in claim 5, wherein the amount of at least one of polybutenyl succinimide and polybutenyl succinimide derivative contained is 0.1 to 15% based on the total mass of the lubricating oil.

7. The valve train as claimed in claim 1, wherein the lubricating oil includes zinc dithiophosphate, and the amount of the zinc dithiophosphate is 0.1% or less based on the total mass of the lubricating oil.

* * * * *